United States Patent [19]

Sekiya

[11] Patent Number: 4,785,297

[45] Date of Patent: Nov. 15, 1988

[54] DRIVER CIRCUIT FOR MATRIX TYPE DISPLAY DEVICE

[75] Inventor: Fukuo Sekiya, Tokorozawa, Japan

[73] Assignee: Citizen Watch Company Limited, Tokyo, Japan

[21] Appl. No.: 935,101

[22] Filed: Nov. 24, 1986

Related U.S. Application Data

[63] Continuation of Ser. No. 564,992, Dec. 23, 1983, abandoned.

[30] Foreign Application Priority Data

Dec. 24, 1982 [JP] Japan ..... 57-229554

[51] Int. Cl.[4] ..... G09G 3/36

[52] U.S. Cl. ..... 340/802; 340/784; 340/801; 307/272.2; 377/73; 377/115

[58] Field of Search ..... 340/784, 801, 802, 805; 307/289–292, 590, 593, 272.2; 377/56, 64, 65, 73, 75, 76, 106, 115, 116, 129

[56] References Cited

U.S. PATENT DOCUMENTS

| | | | |
|---|---|---|---|
| 3,577,086 | 5/1971 | Kilman | 377/76 |
| 3,675,049 | 7/1972 | Haven | 377/73 |
| 3,912,950 | 10/1975 | Tada | 377/115 |
| 4,495,628 | 1/1985 | Zasio | 307/272.2 |
| 4,495,629 | 1/1985 | Zasio et al. | 307/272.2 |
| 4,542,301 | 9/1985 | Nabaru | 377/76 |
| 4,612,659 | 9/1986 | Starke | 377/129 |

*Primary Examiner*—Marshall M. Curtis

*Attorney, Agent, or Firm*—Jordan and Hamburg

[57] ABSTRACT

A drive circuit for producing scanning pulses to successively select row or column conductors of a matrix display device of the type having an active element provided for each display element in the matrix, the drive circuit comprising a shift register made up of a set of cascade-connected master-slave flip-flops, with both the master outputs and the "slave" outputs being utilized to form the scanning pulses. The number of flip-flop stages required is reduced by ½, by comparison with prior art drive circuits using master-slave flip-flops, and the frequency of the clock pulse signal required to drive the shift register is ½ of that required in the case of a prior art circuit.

10 Claims, 9 Drawing Sheets

DRIVER CIRCUIT FOR MATRIX TYPE DISPLAY DEVICE

This application is a continuation of application Ser. No. 564,992 filed Dec. 23, 1983 now abandoned.

BACKGROUND OF THE INVENTION

The present invention relates to a drive circuit for producing scanning pulses to successively select the row conductors or column conductors of a planar type of display, and in particular an "active matrix" type of display, i.e. a display device based on liquid crystal display elements, for example, in which an individual switching element such as a thin-film transistor is provided for each display element, to control the transfer of data to the display element.

With prior art drive circuits for generating such scanning pulse signals, as will be described hereinafter in detail, the circuit configuration is usually based upon a set of master-slave flip-flops connected in series as a shift register. This enables the circuit to be made very simple, since the desired scanning pulses can be directly obtained from either the set of "master" outputs or the set of "slave" outputs of the shift register. However with such a circuit it is necessary to provide one master-slave flip-flop for each scanning pulse, i.e. to provide one master-slave flip-flop for each row of the display matrix in the case of a row drive circuit, or one master-slave flip-flop for each column of the matrix in the case of a column drive circuit. However if such a display is used in a miniature device such as an ultra-small television receiver, then it is desirable to reduce the circuit size as far as possible and in addition to minimize power consumption. It is therefore desirable to reduce the number of elements used to form peripheral circuits such as the row and column drive circuits, and the power consumed therein.

SUMMARY OF THE INVENTION

With a drive circuit according to the present invention, each of a set of scanning signal pulses to be generated to successively select a set of conductors (i.e. row conductors or column conductors) of a matrix display panel is output from a "master" output or a "slave" output of a shift register comprising a set of master-slave flip-flops, or is generated by logically combining a mutually adjacent "master" output and "slave" output in a gate circuit. That is to say, all of the "master" outputs and "slave" outputs of the shift register are used in generating the scanning signal pulses. This differs from such drive circuits of the prior art, in that with such prior art circuits only the set of "master" outputs or only the set of "slave" outputs is utilized, but these are not used in combination. Thus it is necessary to provide a separate master-slave flip-flop for each matrix conductor to be selected, using such a prior art drive circuit.

DESCRIPTION OF THE PREFERRED EMBODIMENTS

Figure 1:
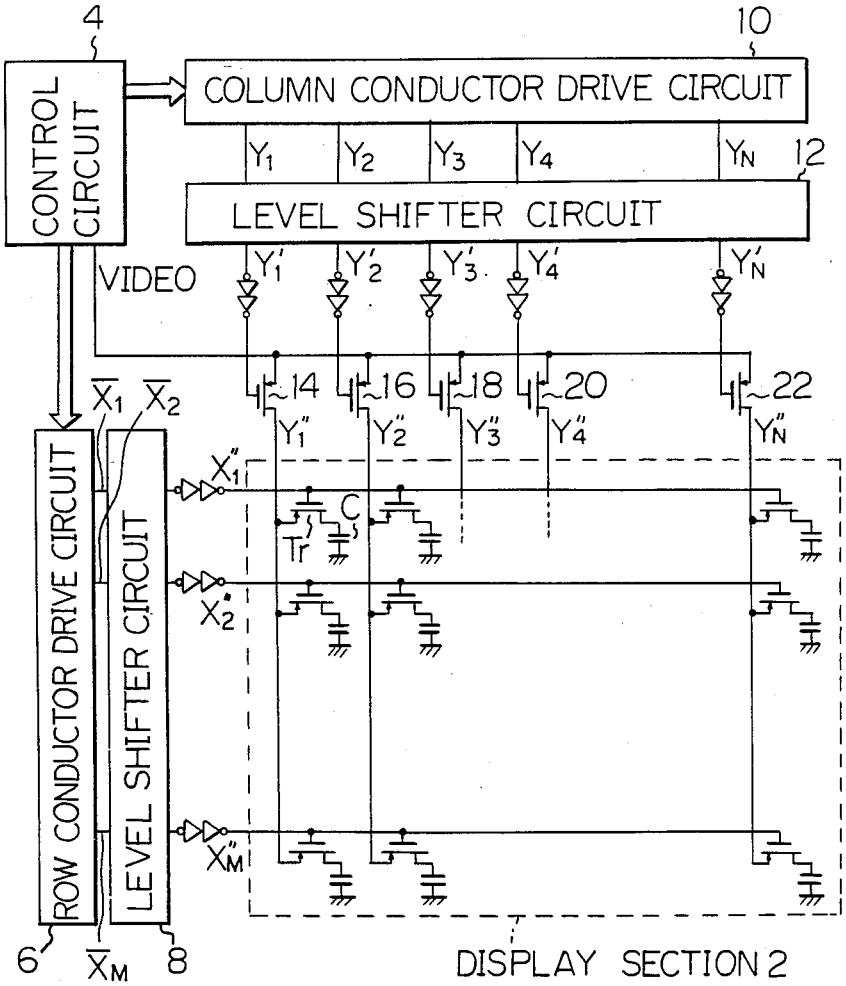
FIG. 1 is a block circuit diagram of a liquid crystal display matrix employing thin-film transistor switching elements, and the necessary peripheral circuits.
Figure 2:
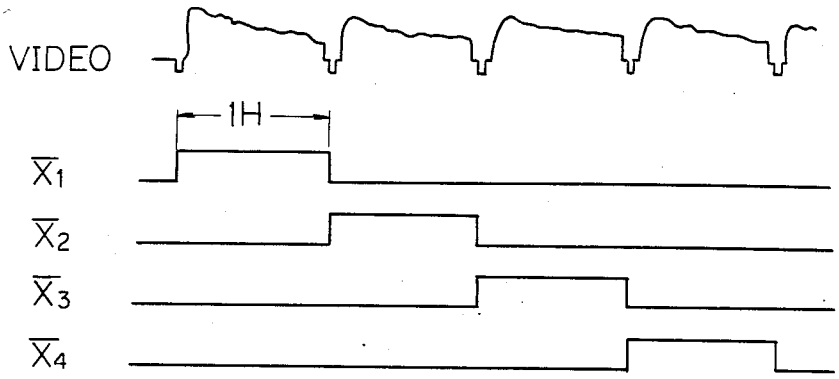
FIGS 2 and 3 are timing charts for assistance in describing the circuit of FIG. 1.

FIG. 1 is a block circuit diagram of an "active matrix" type of display device to which the drive method of the present invention is applicable. This incorporates liquid crystal display elements, each controlled by a switching element comprising a thin-film amorphous silicon transistor. In FIG. 1, Y"1, Y"2, . . . Y"m denote a set of column conductors, while X"1, X"2, . . . X"m denote a set of row conductors. A transistors Tr is provided at each intersection of the row conductors and column conductors, with the gate electrode thereof connected to one of the row conductors and one of the channel electrodes connected to a column conductor. The other channel electrode of a transistor is connected to ground potential through a capacitor C. This capacitor can comprise the self-capacitance of a liquid crystal display element controlled by that transistor, or can be an additional capacitor coupled across the liquid crystal display element. Numeral 2 denotes the display section. A control section 4 supplies various signals including clock signals and a video signal, required for operation of the display. A row conductor drive circuit 6 produces a set of row selection signal pulses X1, X2 . . . shown in FIG. 2, with each of these row selection signal phases being produced during a corresponding horizontal scanning interval 1H of the video signal.

Numeral 8 denotes a level shifter circuit for shifting the potential level of the output selection signal pulses from row drive circuit 6. The resultant output pulses from level shifter circuit 8 are applied to corresponding row conductors X"1, X"2, . . . X"m, so that all of transistors Tr in a row of display elements are set in the ON (i.e. conducting) state when the corresponding row selection signal pulse is output from the row drive circuit during a corresponding horizontal scanning interval 1H.

Figure 3:
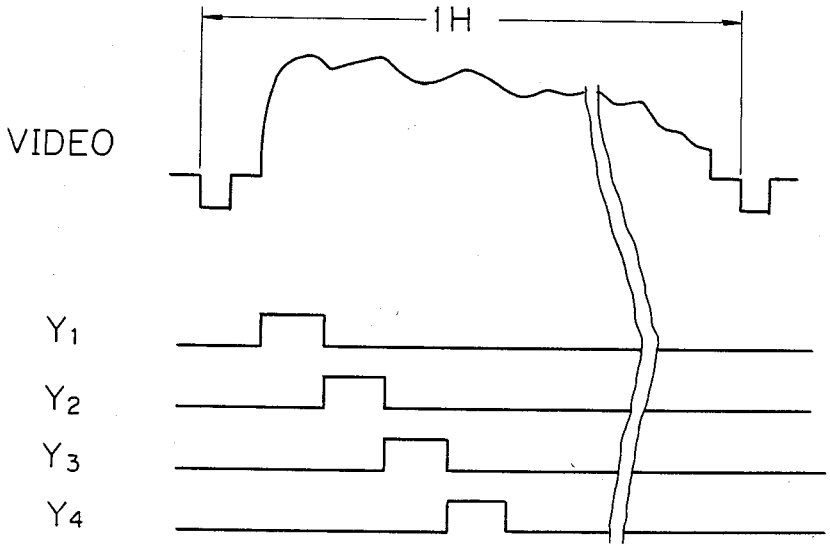

A column conductor drive circuit 10 produces selection signal pulses for successively coupling the video signal to column conductors Y"1, Y"2, . . . The duration of each of these column conductor selection signal pulses is approximately equal to the duration of a horizontal scanning interval 1H divided by the number of column conductors, as illustrated in FIG. 3.

A level shifter circuit 12 raises the potential level of the output pulses from column conductor drive circuit 10, and the resulting level-shifted selection signal pulses are applied to the gate electrodes of corresponding ones of transistors 14, 16, 18, . . . , to thereby sequentially set these transistors in the ON state. The video signal from control circuit 4 is applied in common to one of the channel electrodes of each of these transistors 14, 16, 18, . . . , so that the video signal is successively connected to the column conductors Y"1, Y"2, . . . As a result, corresponding portions of the video signal are stored in appropriate ones of capacitors C of each row of display elements during each horizontal scanning interval.

Thus, the video signal is read into the display elements in a line-at-a-time manner, by successive rows.

In the case of a miniature type of display panel, the row conductors and column conductors shown, together with the other circuits shown in FIG. 1 (other than parts of control circuit 4) are formed upon one substrate of the display panel, while a common electrode is formed on the opposing substrate, with liquid crystal being sandwiched between the two substrates. Such a display panel is applicable to reproducing television images, etc.

Figure 4:
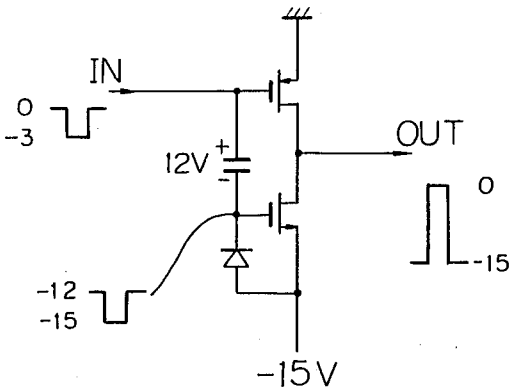
FIG. 4 shows a circuit diagram of an example of a level shifter circuit.

Generally, a signal amplitude of the order of 15 V is required to drive the row conductors and column conductors, while the row conductor and column conductor drive circuits can be operated with signal levels of the order of 3 to 5 V, to minimize power consumption. It is therefore necessary to provide level shifting circuits to interface between these different operating voltage levels. Such a level shifter circuit should have a high speed of response and low static current drain, and a typical circuit suitable for this application is shown in FIG. 4.

Figure 5:
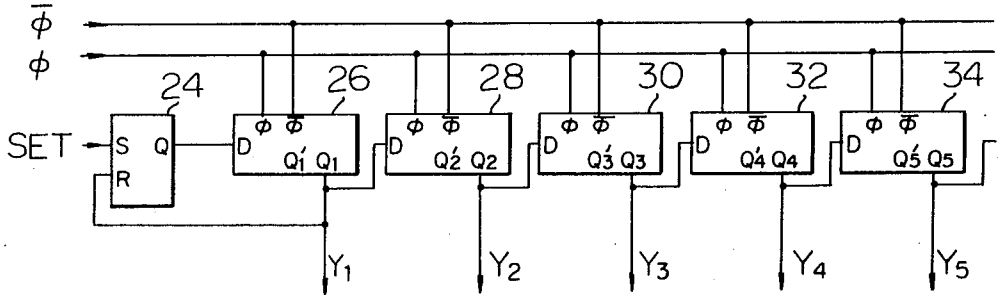
Fig. 5 PRIOR ART
FIG. 5 is a circuit diagram of a prior art type of column conductor drive circuit.
Figure 6:
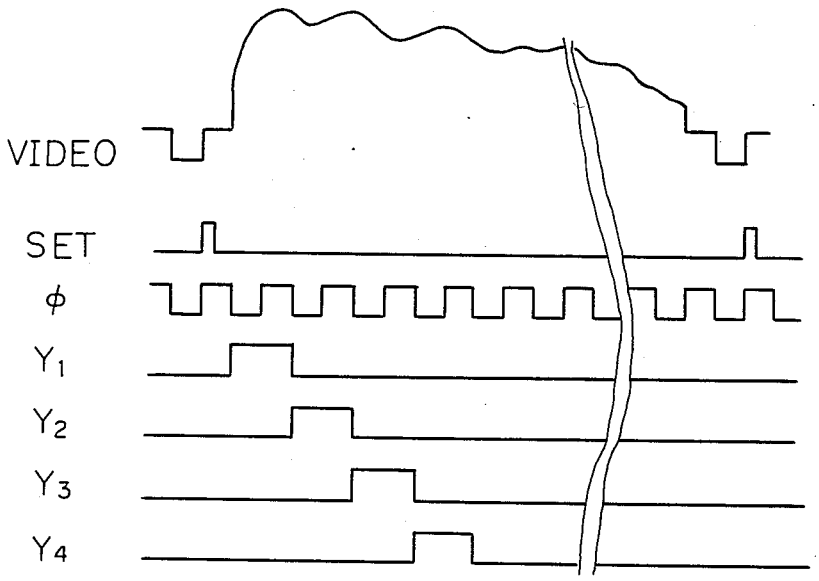
FIG. 6 is a timing chart for assistance in describing the circuit of FIG. 5.

The present invention is directed towards an improvement in the row conductor and column conductor drive circuits of such an "active matrix" display device, i.e. column conductor drive circuit 10 and row conductor drive circuit 6 shown in FIG. 1. FIG. 5 shows a typical art configuration for a column conductor drive circuit. This comprises a set of master-slave flip-flops 26 connected in cascade to form a shift register as shown, with clock signals $\overline{\phi}$ and $\phi$ being applied to the clock terminals of each flip-flop stage. The period of this clock pulse signal train determines the pulse width of the output signal pulses Y1, Y2, . . . In this example, all of these pulses are obtained from the "slave" outputs of the master-slave flip-flops. The data input terminal of the first stage master-slave flip-flop is coupled to the Q output of a set-reset flip-flop 24, whose reset terminal is coupled to the "slave" output Q1 of master-slave flip-flop 26. A "set" signal applied to the set terminal of flip-flop 24 is produced in synchronism with the horizontal sync pulse portion of the video signal, as illustrated in FIG. 6. As result, signal pulses Y1, Y2, . . . are sequentially output from master-slave flip-flops 26, 28, 30, . . . during each horizontal scanning interval.

With such a prior art drive circuit, the number of master-slave flip-flop stages required is identical to the number of matrix conductors which are to be scanned. It is an objective of the present invention to simplify such a drive circuit. This is accomplished by utilizing both the "master" outputs and "slave" outputs of a set of master-slave flip-flops connected as a shift register, to form the desired selection signal pulses. This enables the number of master-slave flip-flop stages required to be reduced by half, and also enables the required frequency of the clock signal driving the shift register to be reduced by half.

Figure 7A:
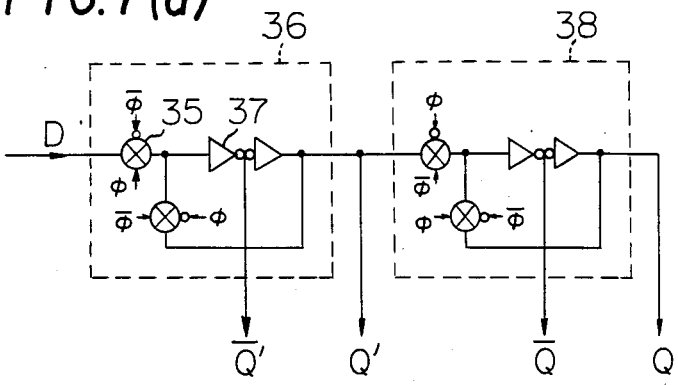
FIGS. 7(*a*), 7(*b*), 7(*c*) and 8 are timing charts for assistance in describing the operation of a drive circuit according to the present invention.
Figure 7B:
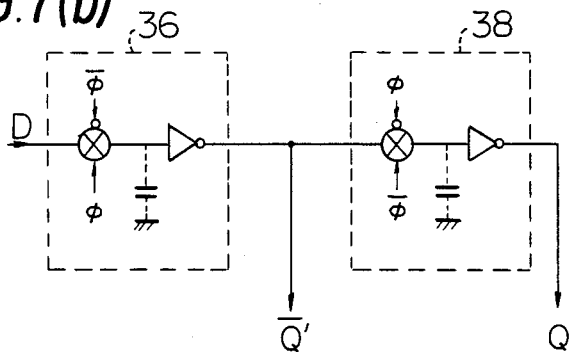
Figure 7C:
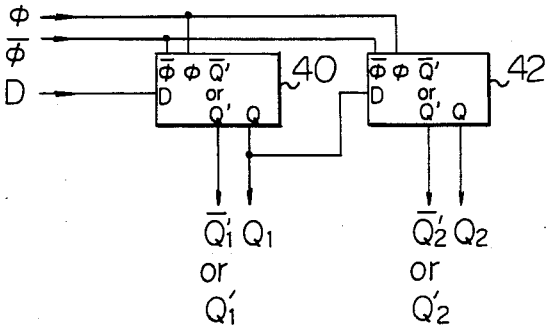

FIG. 7(*a*) and FIG. 7(*b*) each show circuit diagrams of a pair of latch circuits, connected in a configuration generally utilized as a master-slave flip-flop, and referred to as such in the present specification and claims. FIG. 7(*a*) shows a static type of master-slave flip-flop, while FIG. 7(*b*) shows a dynamic type of master-slave flip-flop. Each circuit comprises a combination of transmission gates 35 and inverters 37. Numeral 36 denotes a master section and numeral 38 a slave section, in each case. Q′ and Q′ denote "master" outputs, and Q and Q denote "slave" outputs. In both the circuits of FIGS. 7(*a*) and 7(*b*), when the clock signal $\phi$ is high, at least one output signal is produced from the first latch circuit 36 which corresponds to the current state of the input signal D, i.e., which is identical to or the inverse of the logic state of that input signal. When the clock signal goes from the high to the low level, the state of the input signal D at the time of transition of the clock signal is stored in the first latch circuit, and thereafter an output signal is produced from the output of the first latch circuit which corresponds to the stored input signal state (i.e., is identical to or the inverse of that signal state). The second latch circuit 38 operates in an identical manner to the first latch circuit 36, but responds to the clock signal in the opposite sense to first latch circuit 36, i.e., storing the input signal state when the clock signal changes from the low to the high level, and producing an output signal corresponding to the current state of the input signal thereto, when the clock signal is at the low level. The output of the first latch circuit 36 is connected to the input of the second latch circuit 38.

Figure 8:
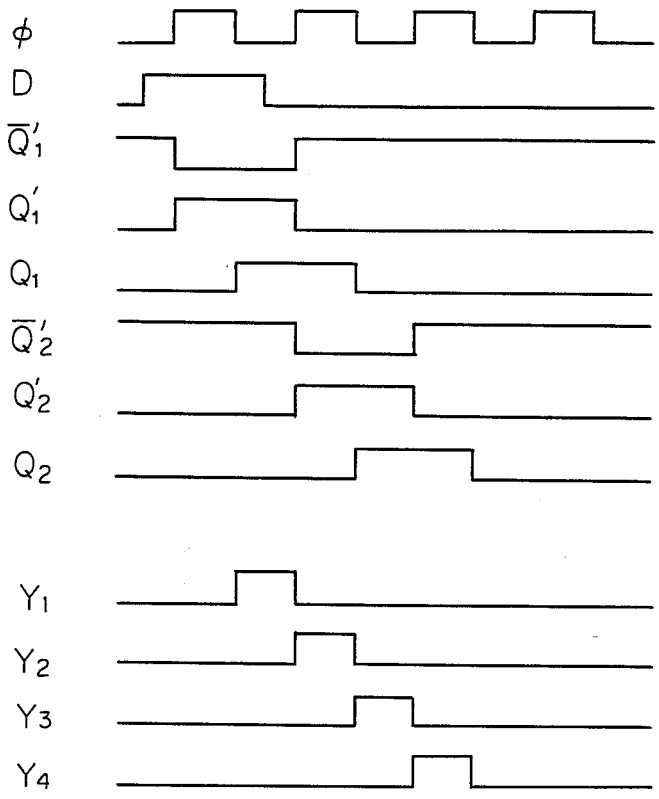

FIG. 8 shows waveform diagrams of output signals from a 2-stage shift register having the form shown in FIG. 7(*c*), which is formed of master-slave flip-flops 40 and 42, each of the form shown in FIGS. 7(*a*) or 7(*b*). It will be apparent that scanning pulse Y1 could be produced by taking the logical AND product of outputs Q1′ and Q1, pulse Y2 could be obtained as the AND product of outputs Q1 and Q′2, and Y3 could be obtained as the AND product of outputs Q2′ and Q2, while pulse Y4 could be obtained as the AND product of output Q2 and Q′3, where Q′3 is the "master" output from a third-stage master-slave flip-flop (not shown in the drawings). Thus, the pulses Y1 to Y4 could be generated almost entirely by only two master-slave flip-flop stages, so that it can be understood that the number of flip-flops required can be reduced by half by comparison with conventional drive methods. It will also be apparent from the relationships between outputs Y1 to Y4 and clock signal pulses $\phi$ in FIG. 8 that the frequency of the clock signal driving the drive circuit shift register is reduced by half with the method of the present invention.

Figure 9:
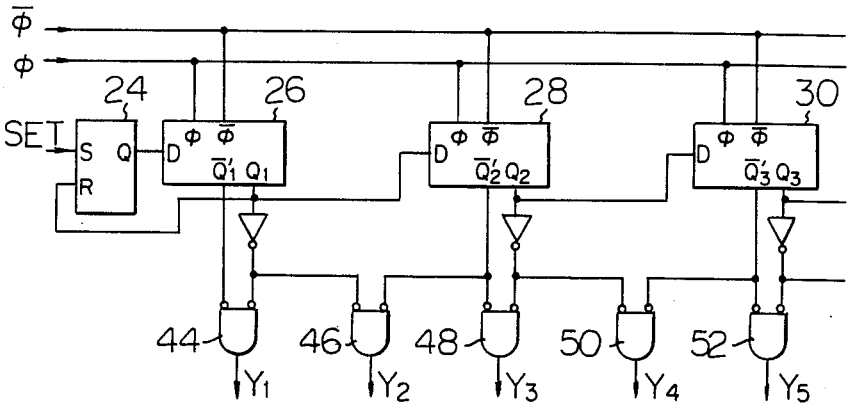
FIGS. 9, 10, 11 and 12 are embodiments of drive circuits according to the present invention.
Figure 10:
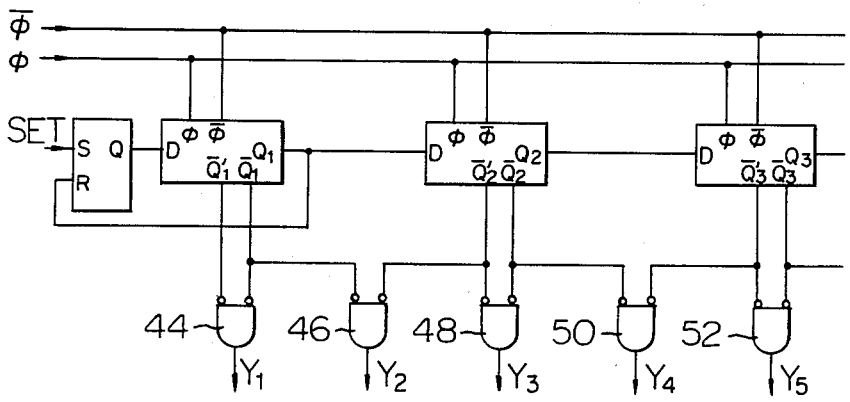

FIGS. 9 and 10 show embodiments of drive circuits according to the present invention. In the embodiment of FIG. 9, dynamic type master-slave flip-flops are used, while in the embodiment of FIG. 10 static type master-slave flip-flops are used. In each case, each of the output pulses Y1, Y2, Y3, . . . is produced as a logical combination of a "master" output and a "slave" output, with the combination being performed by means of logic gates 44, 46, 48, . . .

The relationship between the input signals to the shift register stages and the output pulses Y1, Y2, . . . for the embodiments of FIG. 9 and FIG. 10 are identical to those shown in the waveform diagram of FIG. 8. The embodiments of FIG. 9 and FIG. 10 could each be utilized either as row conductor drive circuit 6 or as a column conductor drive circuit 10 in the display matrix example of FIG. 1.

Figure 11:
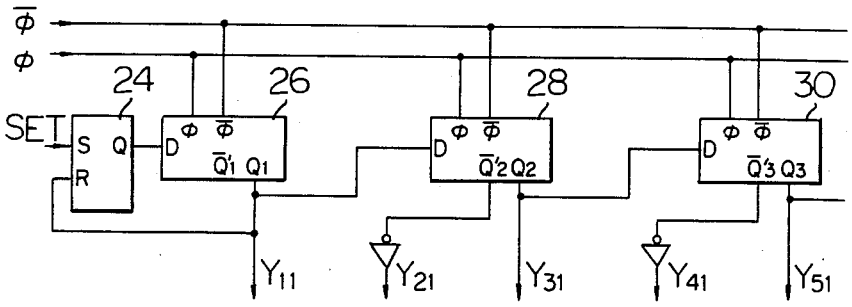
Figure 12:
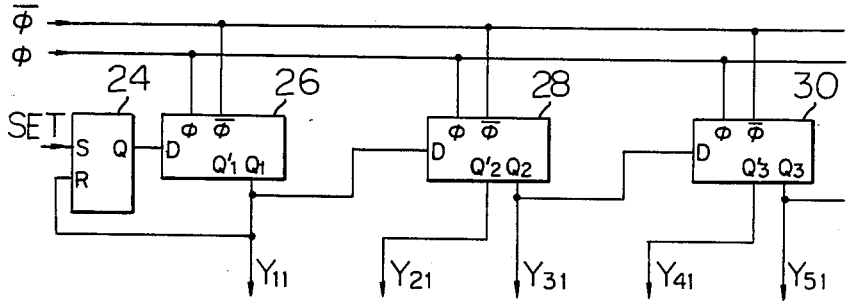
Figure 13:
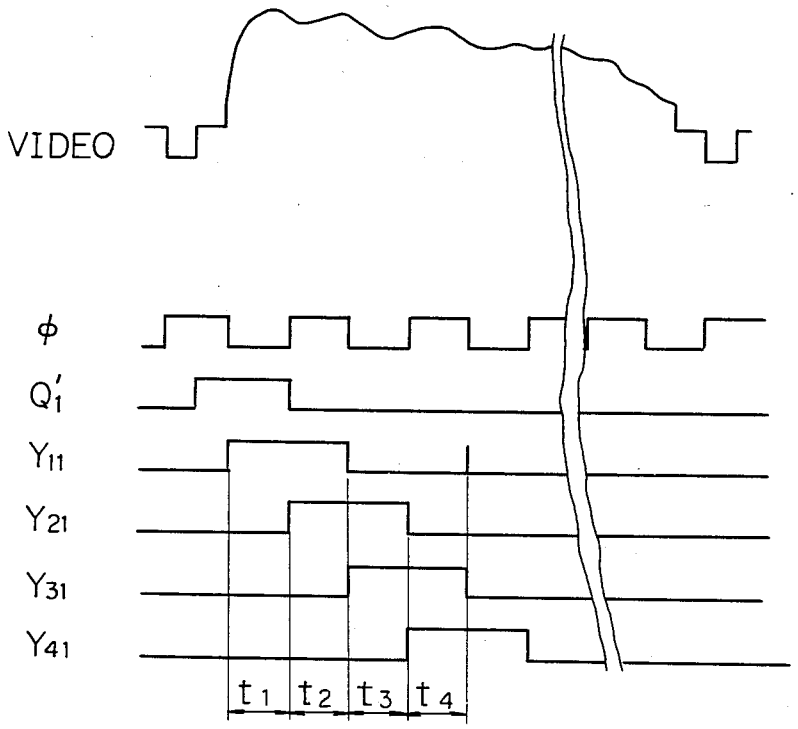
FIG. 13 is a timing chart for describing the operation of the circuits of FIGS. 11 and 12.

FIGS. 11 and 12 show two more embodiments of drive circuits according to the present invention. These are characterized in that no logic gates are used to form the output selection signal pulses Y11, Y21, Y31, . . . Such drive circuits are applicable only to column conductor drive circuit 10 in the example of FIG. 1. Dynamic type master-slave flip-flops are used in the embodiment of FIG. 11, and static type master-slave flip-flops in the embodiment of FIG. 12. In each embodiment, successive output drive pulses are produced alternately from adjacent "master" outputs and "slave" outputs of the shift register, e.g. output Y11 from the first-stage "slave" output, output Y21 from the second-stage "master" output, Y31 from the second-stage "slave" output, and so on. FIG. 13 shows the relationships between the output signal pulses Y11, Y12, . . . produced by the circuit of FIG. 11 or FIG. 12. It can be seen that the duration of each of these output pulses is twice that of each of the output pulses Y1, Y2, . . .of the previous embodiments. As a result, overlap occurs between successive pairs of pulses Y11, Y21, Y31," . . . so that, for example, both of transistors 14 and 16 in the example FIG. 1 will be set in the ON state during a time interval t2 shown in FIG. 13. The operation of transferring the video signal data into the display elements in this case is slightly different from that for the previous embodiments, as follows. Firstly, at the start of a horizontal scanning interval, the video data content which is to be transferred to first column conductor Y"1 is produced (as the video signal) during time interval t2 shown in FIG. 13. Since both transistors 14 and 16 are in the ON state during this time interval, this video data content will also be transferred onto column conductor Y"2, and hence incorrect video data will be temporarily written into the corresponding display element coupled to column conductor Y"2. However during the next time interval t3, this incorrect video data will be overwritten by the correct data, (i.e. the portion of the video signal which occurs during time interval t3), and this remains stored in the corresponding display element of column conductor Y"2 thereafter (following termination of pulse Y21) for a complete scanning field. Thus, even although there is a momentary error in the video data stored in the display elements, this error is almost instantaneously corrected, so that there is no effect upon the image quality provided by the display. A similar sequence of events to that described for column conductor Y"2 occurs for column conductors Y"3, Y"4, . . . Y"n. Thus, no disadvantages results in practice from the overlap between the selection signal pulses produced by the embodiments of FIG. 11 and 12. This allows logic gates 44, 46, 48 . . . of the embodiments of FIG. 9 and FIG. 10 to be eliminated. This will result in an increase in the load which must be driven by the video output from control circuit 4, so that suitable measures must be adopted to handle the increased load.

It will thus be apparent that the present invention enables the number of flip-flop stages required to form a row conductor drive circuit or a column conductor drive circuit of an active matrix type of display device to be reduced by half, and also enables the frequency of the clock signal which drives the shift register to be reduced by half. This enables a simpler circuit configuration to be attained with reduced power consumption. It should be note that a further reduction of power consumption can be obtained, since due to the lower frequency at which the flip-flop stages of the drive circuit operate, these can be operated with a lower value of drive voltage, because of the lower speed of response which is required for the circuit elements.

Although the present invention has been described in the above with reference to a specific embodiment, it should be noted that various changes and modifications to the embodiment may be envisaged, which fall within the scope claimed for the invention as set out in the appended claims. The above specification should therefore be interpreted in a descriptive and not in a limiting sense.

What is claimed is:

1. In a drive circuit for generating selection signal pulses to sequentially select corresponding conductors of a set of conductors coupled to an array of switching elements of a matrix display device, said drive circuit comprising a shift register formed of a plurality of flip-flop circuits connected in cascade, the improvement wherein said flip flop circuits are master-slave flip-flop circuits each having a mssster section and a slave section, each of said master and slave sections having clock and data input terminals, said master section having a first output terminal and said slave section having a second output terminal, said flip-flop circuits comprising means responsive to a signal at the input terminal of the master section and clock signals to said master and slave sections to provide an output at said first and second output terminals with the output at said second terminal being delayed, in response to the clock signals, by a part of a clock cycle with respect to the output at said first terminal, means applying clock and input signals to said shift register, and means deriving said selection signal pulses for selective application to said conductors from both the first and second outputs of each of a plurality of successive of said flip-flop circuits.

2. The drive circuit of claim 1 wherein said deriving means comprises a plurality of logic gate circuits each coupled to both the first and second outputs of a separate one of said flip flops for deriving said selection signal pulses, whereby each of a plurality of said selection signal pulses is formed as a logical combinations of the signal outputs of both the first and second output terminal of a separate flip flop circuit of said shift register.

3. The drive circuit of claim 1 wherein said means for deriving comprises means for deriving successive ones of said selection pulses separately from successive first and second output of said flip-flops of said shift register, whereby successive-pairs of said display matrix conductors are selected simultaneously during corresponding successive time intervals.

4. In a drive circuit for generating selection signal pulses to sequentially select corresponding conductors of a set of conductors coupled to an array of switching elements of a matrix display device, said drive circuit comprising a shift register formed of a plurality of flip flop circuits connected in cascade, the improvement wherein said flip-flop circuits are static master-slave flip-flop circuits each having first and second cascade connected stages with each stage having clock and data input terminals and inverted and noninverted outputs, said flip flop circuits comprising means responsive to a signal at the input terminal of the first stage and clock signals applied to the clock terminals of the first and second stages to provide output signals at said outputs with the outputs of the second stage being delayed by a half clock cycle with respect to the outputs of the respective first stage in response to said clock signals, means applying clock and input signals to said shift register, and means deriving said selection signal pulses from like polarity outputs of both stages of each master-slave flip-flop circuit.

5. The drive circuit of claim 4 wherein said deriving means comprises a first plurality of successive AND gate circuits having inputs connected to like polarity outputs of the two stages of respective master-slave flip flops, and a second plurality of successive AND gate circuits having inputs connected to like polarity outputs of second and first stages of adjacent master-slave flip-flops, the outputs of said AND gate circuits of said first and second plurality being connected to alternate conductors of said matrix.

6. The drive circuits of claim 4 wherein said deriving means comprises means applying the like polarity outputs of the first and second stages of each master-slave flip-flop directly to successive conductors of said matrix in that order.

7. In a drive circuit for generating selection signal pulses to sequentially select corresponding conductors of a set of conductors coupled to an array of switching elements of a mtrix display device, said drive circuit comprising a shift register formed of a plurality of flip-flop circuits connected in cascade, the improvement wherein said flip-flop circuits are dynamic master-slave flip-flop circuits each having first and second cascade connected stages with each of the stages having clock and data input terminals and an output, said flip-flop circuits comprising means responsive to a signal at the input terminal of the first stage and clock signals applied to the clock terminals of said first and second stages to provide outputs from said first and second stages with the output at said second stage being of opposite polarity and delayed by a part of a clock cycle with respect to the output at said first stage in response to said clock signals, means applying clock and input signals to said master-slave flip-flop circuits, and means deriving said selection signal pulses from the outputs of both the first and second stages of a plurality of successive of said master-slave flip-flop circuits.

8. The drive circuit of claim 7 wherein said deriving means comprises an inverting means connected to one said output of each of said master-slave flip-flop, a first plurality of successive AND gate circuits having inputs connected to the outputs of separate inverters and the output of the other stage of the respective master-slave flip-flops, and a second plurality of successive AND gate circuits having inputs connected to the outputs of separate inverters connected to one master-slave flip-flop and the other output of an adjacent flip-flop, the outputs of said AND gate circuits of said first and second plurality being connected to alternate conductors of said matrix.

9. The drive circuit of claim 7 wherein said deriving means comprises an inverting circuit connected to one said output of each of said master-slave flip-flops, and means substantially directly connecting the other outputs of said master-slave flip-flops and the outputs of the respective inverting circuits to successive conductors of said matrix.

10. The drive circuit of claim 2 wherein said deriving means further comprises a plurality of second logic gate circuits each coupled to the second output of one flip-flop circuit and the first outputs of the preceding flip-flop circuits for deriving said first selection signal pulses, whereby each of said further selection signal pulses is formed as a logical combination of the signal outputs of the first and second output terminal of different flip-flop circuits of said shift register.

* * * * *